US009320379B2

(12) United States Patent
Sourain et al.

(10) Patent No.: US 9,320,379 B2
(45) Date of Patent: Apr. 26, 2016

(54) MOTOR-DRIVEN CARRIAGE, AND BLACKOUT EQUIPMENT INCLUDING SUCH A CARRIAGE

(71) Applicant: SOMFY SAS, Cluses (FR)

(72) Inventors: Remi Sourain, Domancy (FR); Josiane Dunand, Vallorcine (FR); Serge Bruno, Marnaz (FR); Pierre-Emmanuel Cavarec, Mont Saxonnex (FR); Fabien Rousseau, Mieussy (FR)

(73) Assignee: SOMFY SAS, Cluses (FR)

( * ) Notice: Subject to any disclaimer, the term of this patent is extended or adjusted under 35 U.S.C. 154(b) by 0 days.

(21) Appl. No.: 14/381,333

(22) PCT Filed: Feb. 27, 2013

(86) PCT No.: PCT/EP2013/053955
§ 371 (c)(1),
(2) Date: Aug. 27, 2014

(87) PCT Pub. No.: WO2013/127872
PCT Pub. Date: Sep. 6, 2013

(65) Prior Publication Data

US 2015/0041079 A1 Feb. 12, 2015

(30) Foreign Application Priority Data

Feb. 28, 2012 (FR) ..... 12 51801

(51) Int. Cl.

| | |
|---|---|
| ***A47H 5/00*** | (2006.01) |
| ***A47H 5/032*** | (2006.01) |
| ***A47H 1/04*** | (2006.01) |
| ***A47H 5/02*** | (2006.01) |
| *B61B 3/02* | (2006.01) |

(52) U.S. Cl.
CPC ..... *A47H 5/0325* (2013.01); *A47H 1/04* (2013.01); *A47H 5/02* (2013.01); *B61B 3/02* (2013.01)

(58) Field of Classification Search
CPC ..... A47H 5/02; A47H 5/0325; A47H 15/02; A47H 15/04; B61B 3/02
USPC ..... 160/331; 16/87.4 R, 96 D, 87.2; 104/89
See application file for complete search history.

(56) References Cited

U.S. PATENT DOCUMENTS

| | | | | |
|---|---|---|---|---|
| 7,686,063 | B2 * | 3/2010 | Kirby et al. | 160/331 |
| 2004/0173117 | A1 * | 9/2004 | Galpin et al. | 105/148 |

(Continued)

FOREIGN PATENT DOCUMENTS

| | | |
|---|---|---|
| DE | 24 36 753 A1 | 3/1975 |
| DE | 25 34 406 A1 | 2/1977 |

(Continued)

OTHER PUBLICATIONS

International Search Report, dated May 28, 2013, from corresponding PCT application.

(Continued)

*Primary Examiner* — Blair M Johnson
(74) *Attorney, Agent, or Firm* — Young & Thompson

(57) ABSTRACT

A motor-driven carriage (100) for opening/closing a curtain, includes a housing (110) that is provided with two members (124, 126) for suspending the housing from a rail (50), wherein a friction wheel (112), which is driven by an electric motor and which is to contact at least one rolling surface (56, 57) of the rail, is rotatably mounted inside the housing. The carriage (100) also includes a cradle (150) provided with two other members (155, 156) for suspending the cradle from the rail (50), which are separate from the members (124, 126) for suspending the housing (110), as well as elements (153, 154) for coupling to the curtain. The cradle is mounted onto the housing (110) and is driven by the housing when the latter moves along the rail, the housing (110) and the cradle (150) optionally being capable of relative movement there between.

16 Claims, 7 Drawing Sheets

(56) References Cited

U.S. PATENT DOCUMENTS

Figure 1:
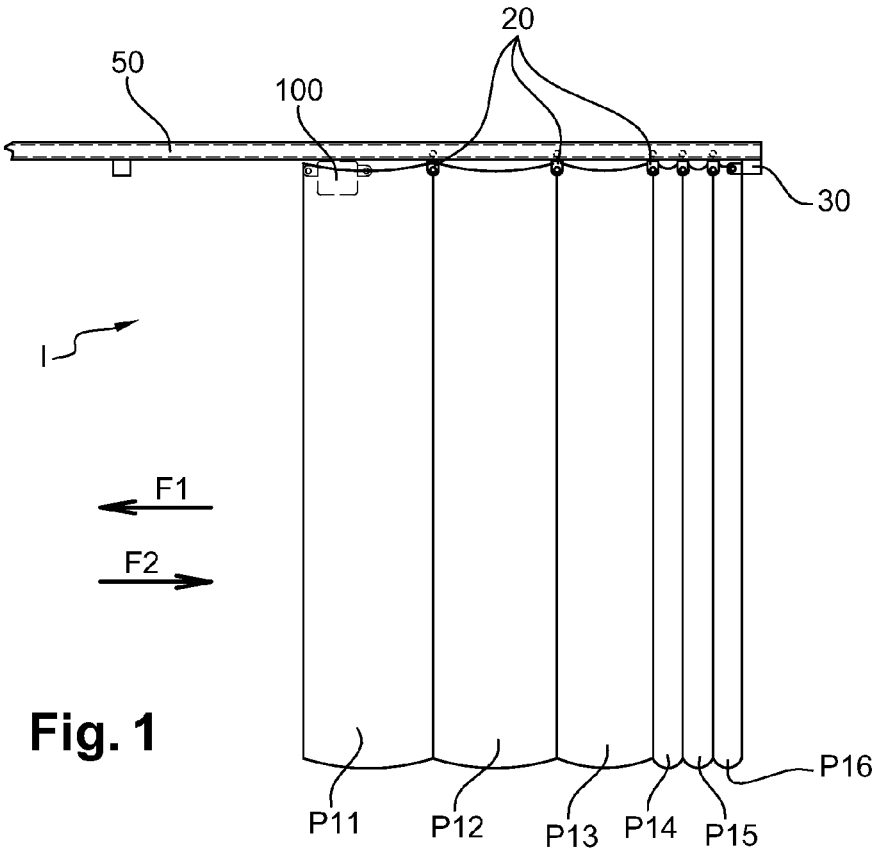

| | | | | |
|---|---|---|---|---|
| 2013/0160955 | A1 | 6/2013 | Cavarec et al. | |
| 2015/0041078 | A1 * | 2/2015 | Perache et al. | 160/331 |
| 2015/0041079 | A1 * | 2/2015 | Sourain et al. | 160/331 |

FOREIGN PATENT DOCUMENTS

| | | | |
|---|---|---|---|
| DE | 34 37 457 | A1 | 4/1986 |
| FR | 2 669 238 | A1 | 5/1992 |
| FR | 2 962 317 | A1 | 1/2012 |
| JP | 2005-095364 | A | 4/2005 |
| WO | 2012/004530 | A1 | 1/2012 |

OTHER PUBLICATIONS

FR Search Report, dated Oct. 17, 2012, from corresponding FR application.

* cited by examiner

MOTOR-DRIVEN CARRIAGE, AND BLACKOUT EQUIPMENT INCLUDING SUCH A CARRIAGE

FIELD OF THE INVENTION

The invention relates to a motor-driven carriage for opening/closing a curtain, said carriage being capable of moving along a rail. The invention also relates to blackout installation that comprises a rail, a motor-driven carriage of the aforementioned type, and a curtain driven by said carriage.

BACKGROUND OF THE INVENTION

Different devices exist that make it possible to maneuver the opening of a blackout curtain for an opening such as a window. One solution consists of motorizing the movement of a head carriage on which one end of the curtain is fastened. This head carriage may comprise guide wheels, in general at least two pairs of wheels, that roll on rolling tracks formed along a rail fastened near the upper edge of an opening to be blacked out.

It is known from JP-A-2005-095364 to incorporate a friction wheel rotated by an electric motor into a carriage. The contact force between the friction wheel and a rolling surface on which it moves is directly related to the performance of the system. The greater this contact force is, the less the contact wheel risks slipping relative to the rail. It is known from DE-A-24 36 753 to suspend a motor carriage from a rail and generate a contact force between a friction wheel and a rail, taking the direction of movement into account. However, the weight of the first curtain panel is not known and may diverge greatly from one piece of equipment to another. Furthermore, that weight being suspended cantilevered relative to the housing, it creates a tilting torque on the housing. There is therefore a need for a fine adjustment of the contact force between the friction wheel and the rail.

It is also known from DE-A-34 37 457 to arrange a motor carriage inside a rail, which makes it possible to make the contact force between the driving wheels and the rail independent of the load being pulled, i.e., the mass of the curtain. However, a particular geometry of the rail must be provided to house the carriage and the rail may not be curved, with a relatively small curve radius, otherwise the carriage may become jammed in a turn.

It is also known from FR-A-2,962,317 to suspend the housing of a motor-driven carriage for opening/closing a curtain from a rail using two members, one of which can tilt relative to the housing, which adjusts the contact force between the rail and a friction wheel supported by that housing. The forces exerted by the curtain on the suspension member, which pivots relative to the housing, can decrease the effectiveness of the drive system contained in the housing.

SUMMARY OF THE INVENTION

The invention more particularly aims to resolve these drawbacks by proposing a new motor-driven carriage that makes it possible to drive a curtain effectively with a substantially constant contact force between a friction wheel and a rolling surface of a standard rail that may have curved zones.

To that end, the invention relates to a motor-driven carriage for opening/closing a curtain, including a housing that is provided with two members for suspending the housing from a rail and wherein a friction wheel, which is driven by an electric motor and which comes into contact with at least one rolling surface of the rail, is rotatably mounted inside the housing. According to the invention, this carriage also comprises a cradle provided, on the one hand, with two members, for suspending the cradle from the rail that are independent of the suspension members of the housing, and, on the other hand, curtain couplings means for coupling to the curtain, while the cradle is mounted onto the housing and is driven by the housing when the latter moves along the rail, the housing and the cradle being capable of relative movement.

Owing to the invention, the driving function of the carriage is performed by the elements included in the housing, in particular the friction wheel and its motor, while the coupling function of the curtain is performed by the cradle. The member(s) for suspending the housing support(s) only the weight of that housing and the elements they contain, that weight being known and constant. Furthermore, separating the cradle from the housing makes it possible to avoid a need for fine adjustments of the pressure between the friction wheel and the rail: the tilting torque created by the weight of the first curtain panel is exerted on the cradle and has no impact on the housing itself. Furthermore, the driven load, corresponding to all or part of the curtain based on the position of the motor-driven carriage along the rail, is variable and supported by the member(s) for suspending the cradle and optionally by the follower carriages. As a result, the variation caused in the pulling force, transmitted by the relative movement of the cradle with respect to the housing, positively influences the contact force between the friction wheel and the rolling surface of the rail. The tilting torque created by the curtain is exerted on the cradle. It is effectively supported by both suspension members of the cradle and has no substantial impact on the housing. Owing to the two sets of suspension members that respectively equip the housing and the cradle, said housing and said cradle can be mechanically separated from one another, inasmuch as they can move relative to one another. Furthermore, owing to the possibility of relative movement between the carriage and the cradle and the compactness of the motor-driven carriage, it is possible for the motor-driven carriage to follow a curved journey along the rail, with a relatively small curve radius, approximately 200 mm.

According to advantageous, but optional aspects of the invention, such a carriage may incorporate one or more of the following features, considered in any technically allowable combination:

- The suspension members of the housing support only the weight of the housing and the elements it contains, that weight being constant, whereas the suspension members of the cradle support the driven load, the driven load being variable based on the position of the carriage along the rail.
- The first element comprises two openings, in each of which a suspension member for the second element is engaged with play. This makes it possible to intercalate the skids and rollers, such that the motor-driven carriage has an optimum compactness. This also makes it possible to respect precise dimensions (100 mm) with respect to the width of the first curtain panel.
- The first element is capable of moving at least one suspension member relative to the second element, by varying a contact force between the friction wheel and the rolling surface.
- Each opening has, in a longitudinal direction parallel to a direction of movement of the carriage and in a transverse direction perpendicular to the direction of movement of the carriage, dimensions strictly larger than the dimensions, along the two longitudinal and transverse directions, of the part of the suspension member that is received in that opening.

The first element is the cradle, which is provided with a third opening for the friction wheel, and the second element is the housing.

The third passage opening is situated, along a longitudinal axis of the cradle, between the two passage openings of the suspension members of the housing.

In the mounted configuration of the carriage, the suspension members of the housing are positioned, along the longitudinal axis of the housing, on either side of the suspension members of the cradle, which in turn are positioned, along the axis, on either side of the friction wheel.

The cradle is mounted on the carriage with a possibility of relative movement in a direction parallel to a longitudinal axis of the carriage and in a direction perpendicular to that axis.

Each suspension member of the housing and/or each suspension member of the cradle is equipped with at least one roller or at least one skid interacting with a track of the rail, whereas that roller or that skid is articulated, relative to the housing and/or the cradle, around an axis globally perpendicular to the track of the rail in the configuration of the carriage mounted on the rail and perpendicular to the axis of rotation of the friction wheel. Thus, during a movement of the housing relative to the cradle, the cradle moves the axis of the roller and/or of the rail, and thereby influences the friction force. The greater the weight of the first curtain panel and/or the first driven curtain part is, the more the axis of the roller or the skid is moved relative to the perpendicular axis, and the greater the friction force is. On the contrary, for lightweight curtains, the friction force is lower, which allows lower electricity consumption and greater autonomy.

At least one suspension member comprises two rollers articulated on a support positioned between those rollers, using a shaft received in a circular housing of the support, and that housing has an increasing section toward the rollers.

The cradle is provided with a passageway for the friction wheel.

The housing defines at least one volume for partially receiving the cradle.

The invention also relates to an installation for blacking out an opening, the equipment comprising a rail, a motor-driven carriage as described above, and a curtain coupled on the cradle of the carriage.

Figure 7:
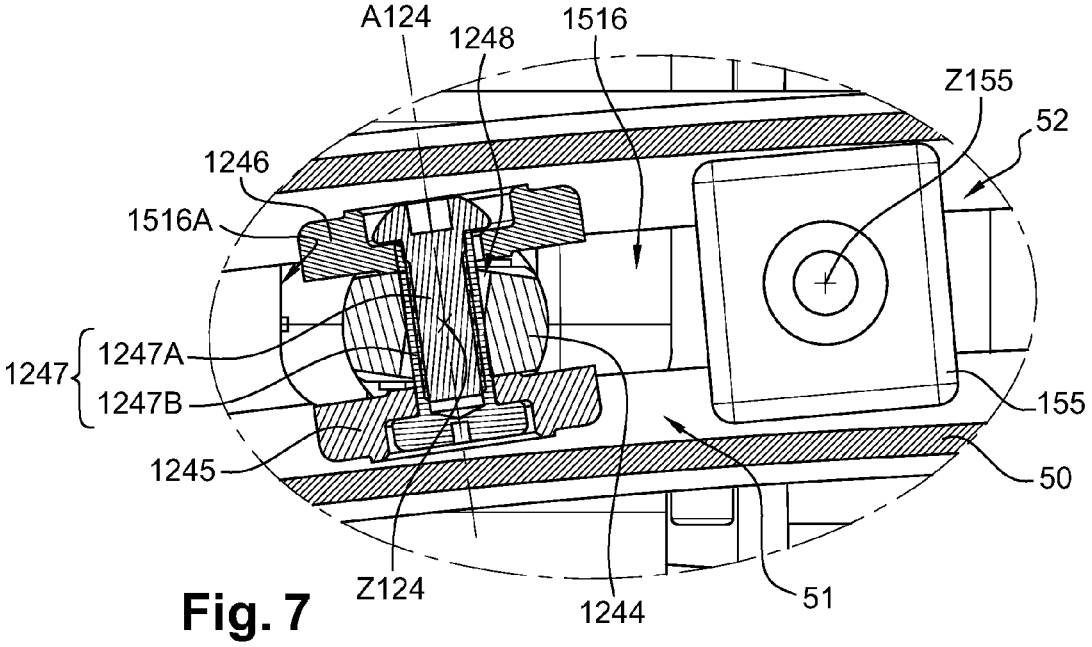
Figure 2:
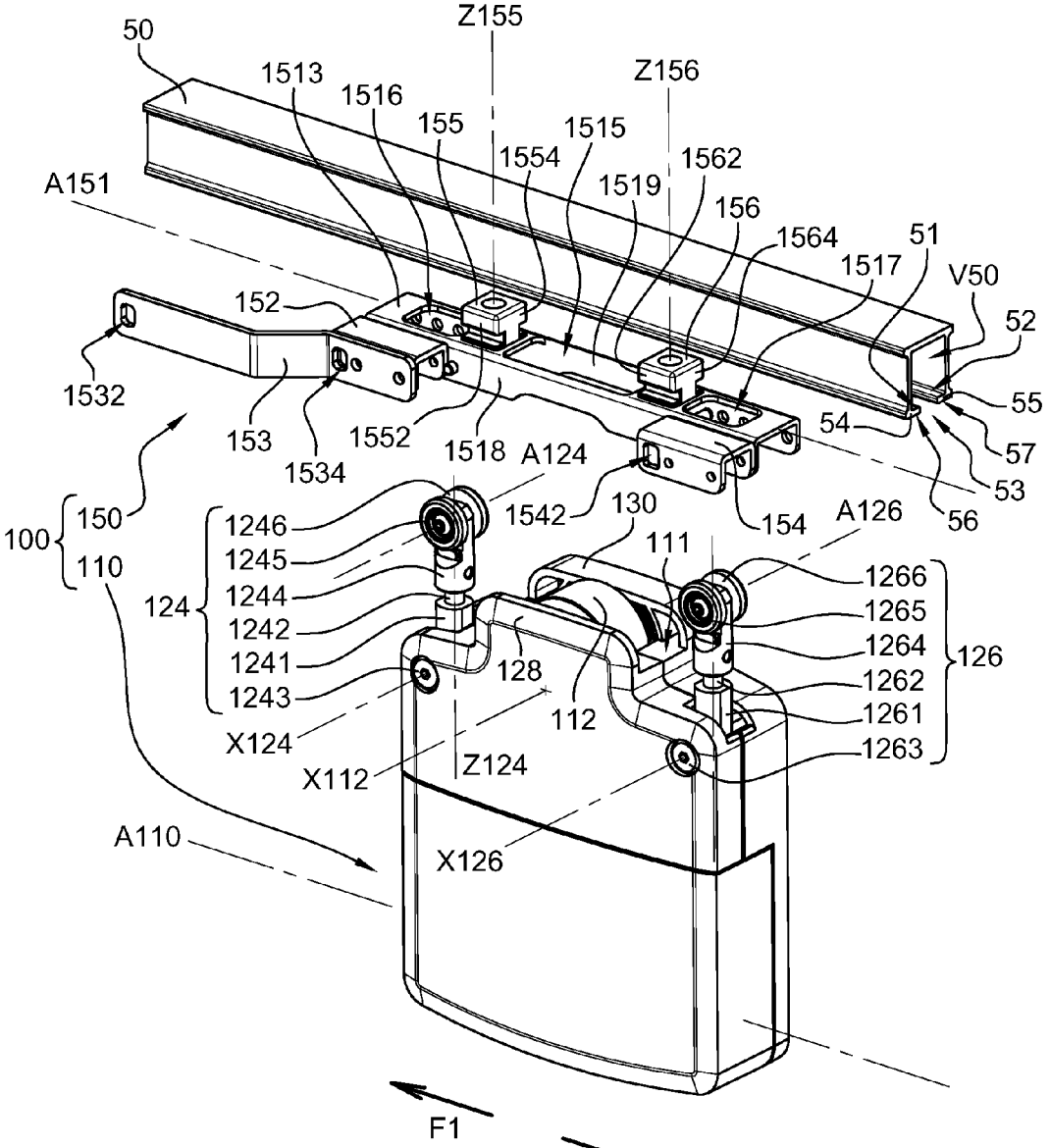
Figure 3:
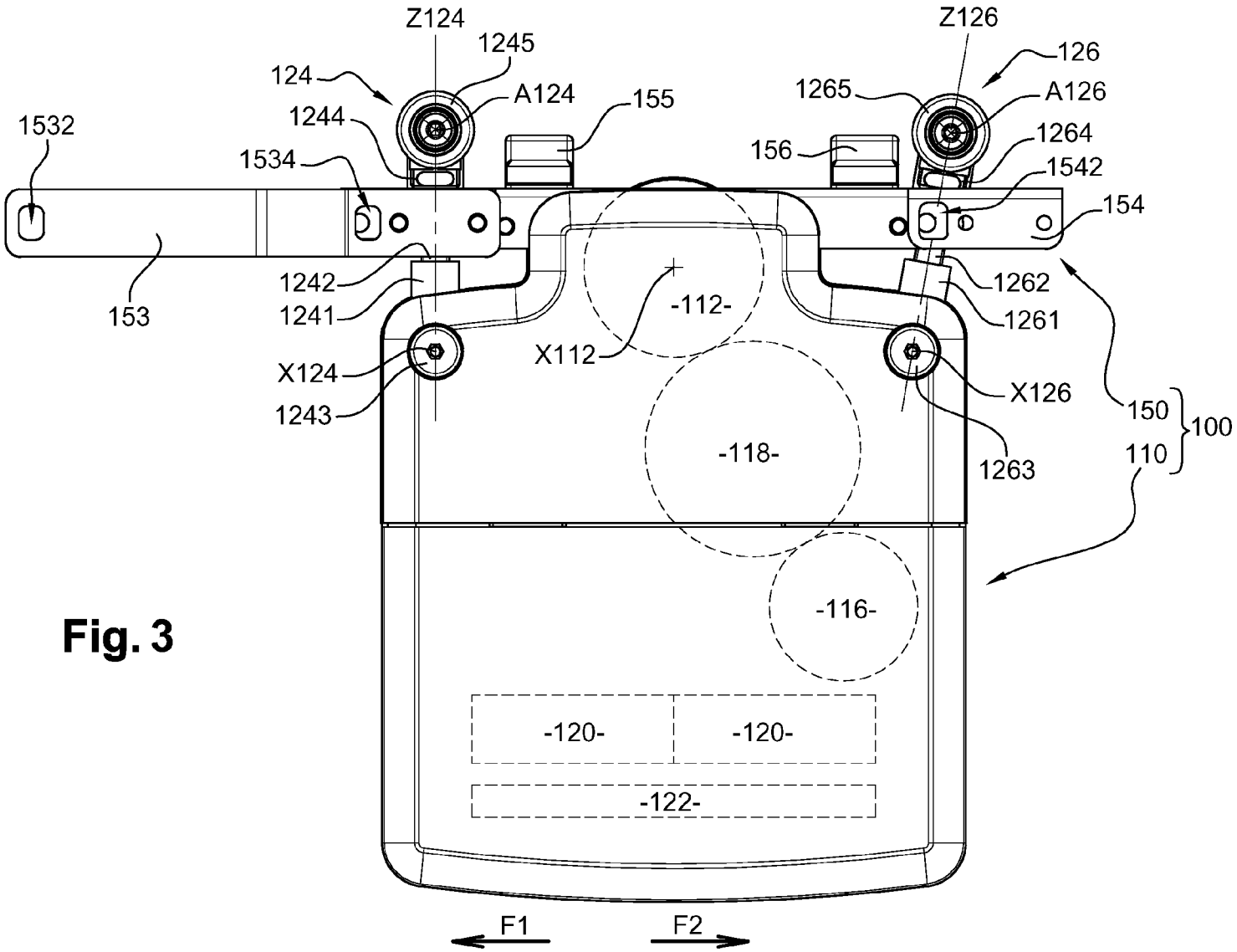
Figure 4:
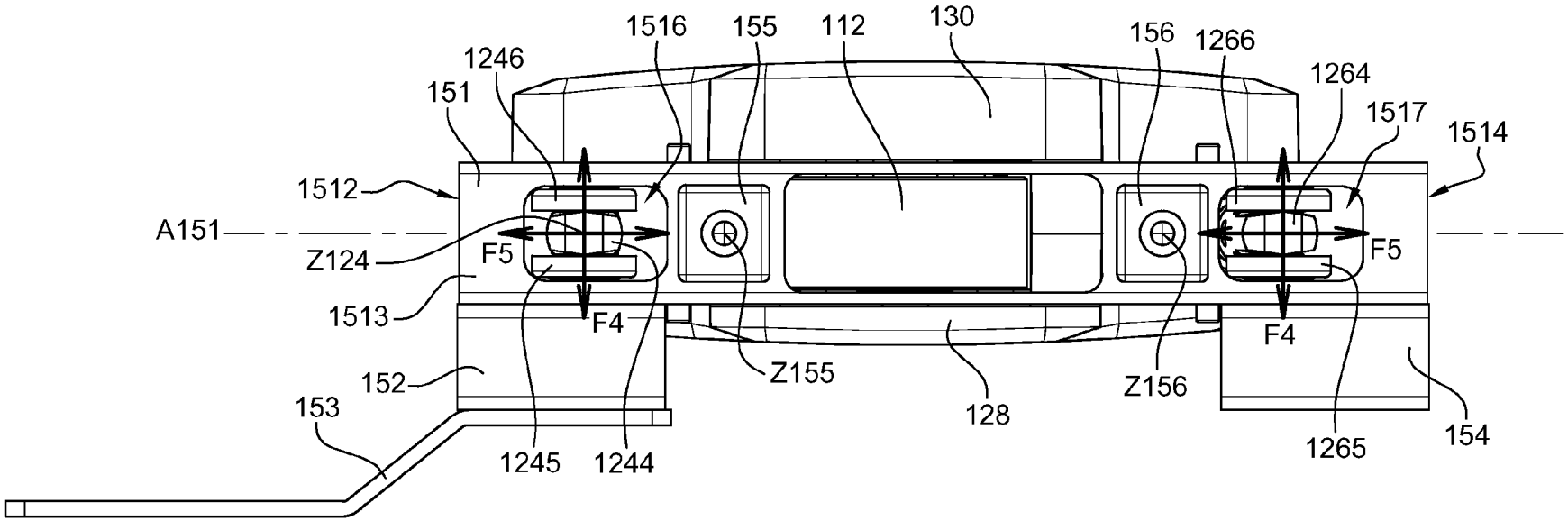
Figure 5:
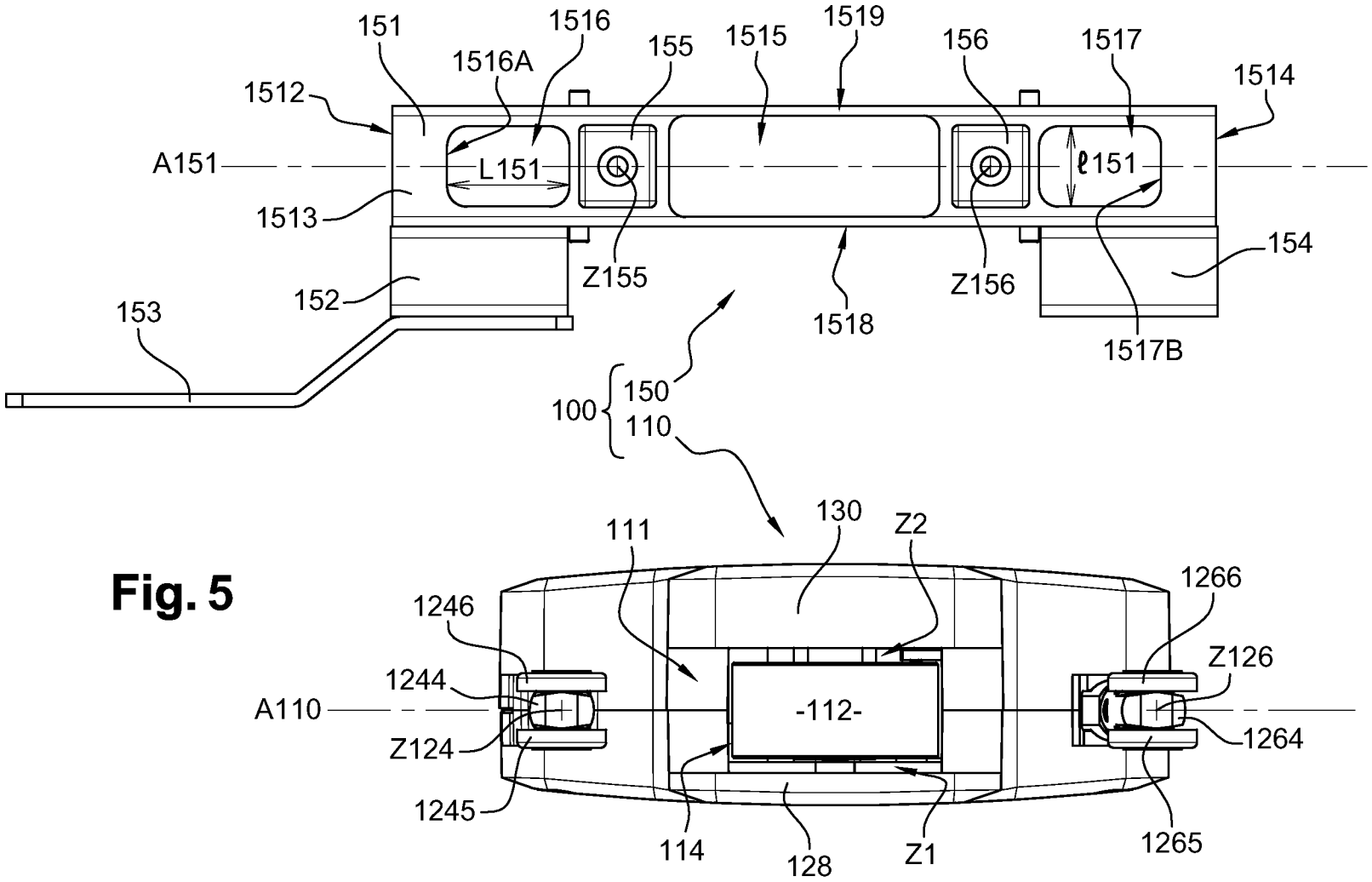
Figure 6:
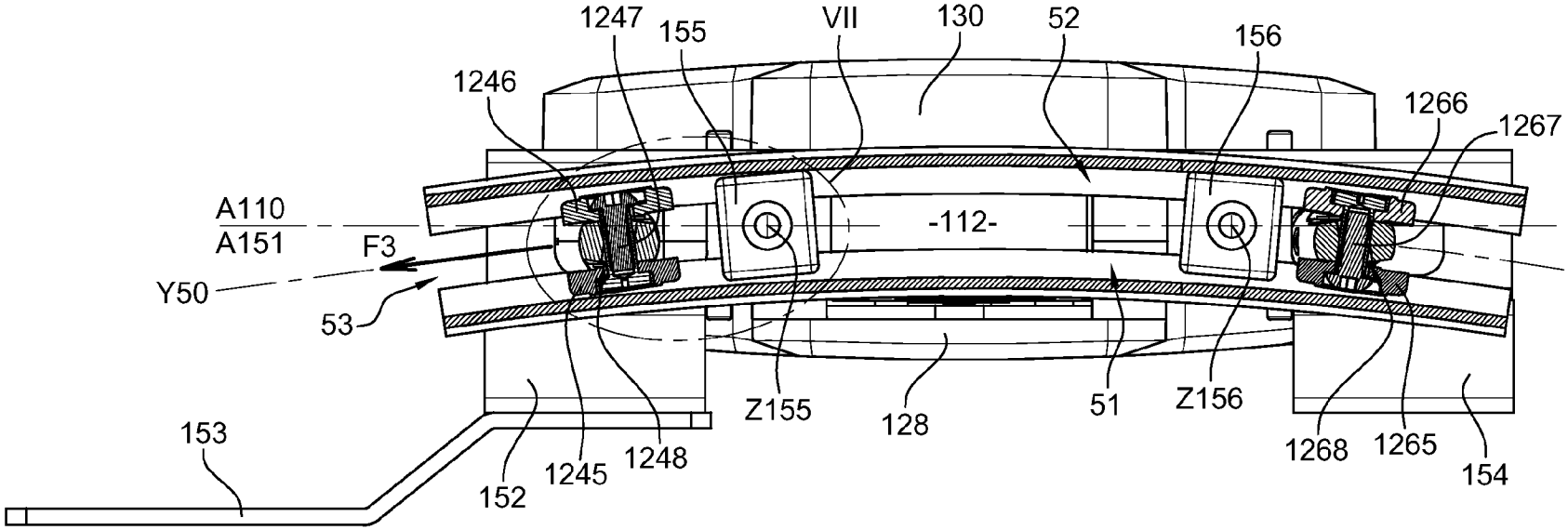
Figure 8:
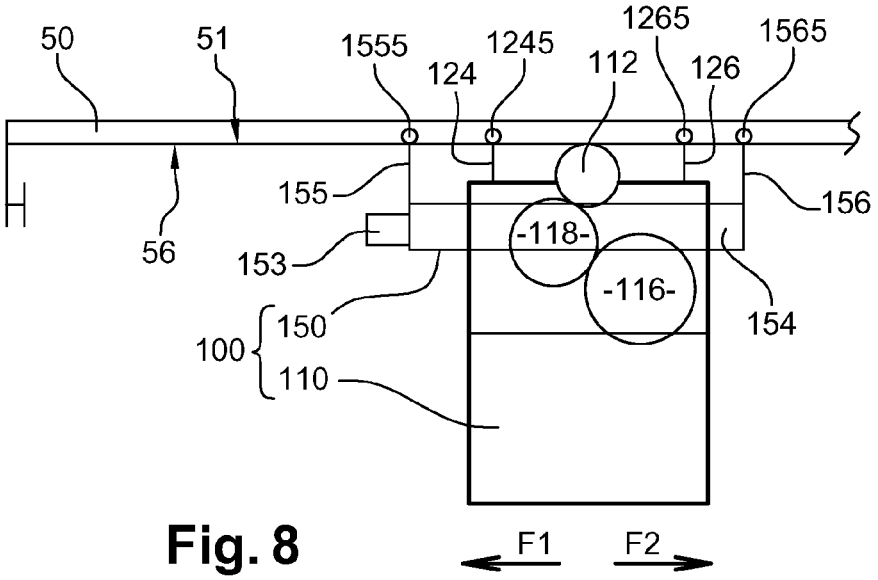
Figure 9:
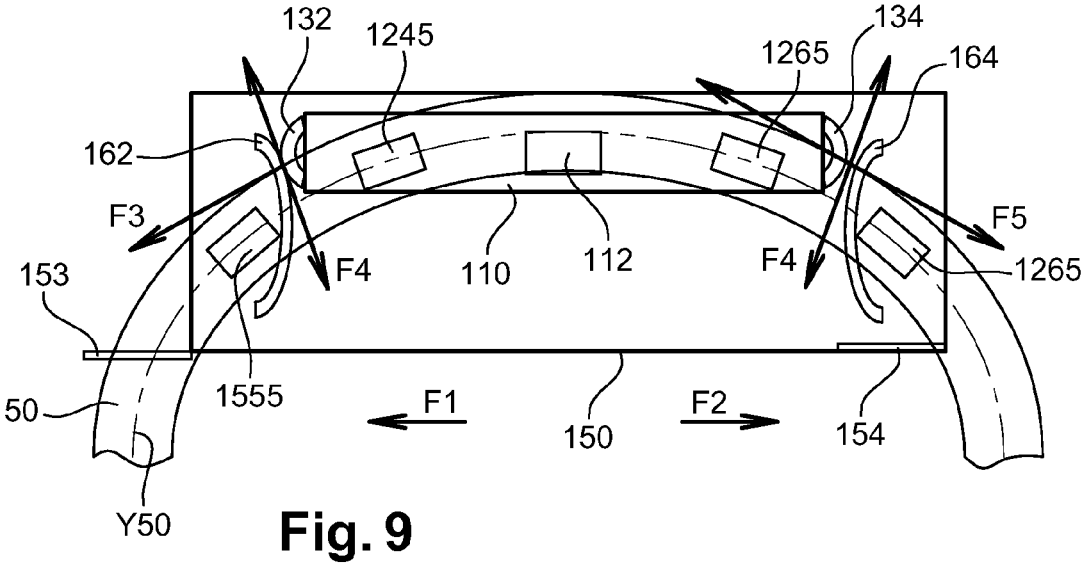

The invention will be better understood, and other advantages thereof will appear more clearly, in light of the following description of two embodiments of a motor-driven carriage and equipment according to its principle, provided solely as an example and done in reference to the appended drawings, in which:

FIG. 1 is a diagrammatic illustration of a curtain installation incorporating a motor-driven carriage according to the invention, FIG. 2 is an exploded perspective view of the carriage and the rail of the equipment of FIG. 1, FIG. 3 is a side view of the carriage, FIG. 4 is a top view of the carriage, FIG. 5 is a top view of the carriage, a housing and a cradle of the carriage being separated from each other, FIG. 6 is a horizontal cross-section of a turning zone of a rail in which the carriage of FIGS. 2 to 5 slides, FIG. 7 is an enlarged view of detail VII in FIG. 6, FIG. 8 is a diagrammatic illustration, in side view, of an installation according to a second embodiment of the invention, and FIG. 9 is a diagrammatic illustration, in top view and enlarged, of the installation of FIG. 8.

FIG. 1 illustrates a system for motorizing a curtain 10 within an installation I for blacking out a window, not shown. The curtain, which forms a blackout screen, is suspended from carriages of two types 20 and 100, using hooks (not shown). Each carriage is equipped with guide wheels rolling on rolling tracks formed along a rail 50 fastened near the upper edge of the window. Thus, the curtain 10 can move along the rail 50. At one of its upper ends, the curtain 10 is coupled to a stop 30 fastened to the rail 50. At its other upper end, the curtain 10 is coupled to a motor-driven head carriage 100, the structure of which is outlined in FIGS. 2 to 7. The curtain 10 is made up of fabric panels P11 to P16 corresponding to the surface of the fabric hanging between two support carriages 20 or between the carriage 100 and the closest support carriage 20.

The curtain 10 is closed by moving the curtain to the left in FIG. 1, in the direction of arrow F1. It is opened by moving it to the right, in the direction of arrow F2.

In the present description, the words "top" and "bottom", "upper" and "lower" are used in reference to an operating configuration of the installation of FIG. 1. The words "front" and "rear" are used relative to the direction of movement of the curtain 10 during closing. Thus, a "front" part is situated on the left in FIG. 1, relative to a "rear" part.

As more particularly shown by FIGS. 2 to 5, the carriage 100 comprises a casing 110 made from a plastic material inside which a friction wheel 112 is partially housed. The latter protrudes from the housing 110 through an opening 114 formed in the upper part of the housing. As shown in FIG. 3, the housing 110 also comprises an electric motor 116, a reducing gear 118, a set of batteries 120 and an electronic control board 122. The elements 116 to 122 make it possible to rotate the wheel 114 around an axis X112 that is horizontal and perpendicular to the forward F1 and backward F2 movement directions of the carriage 100 along the rail 50.

The housing 110 is equipped with a front suspension member 124 and a rear suspension member 126 that extend upward from an upper surface 111 of the housing 110 in which the opening 114 is formed.

The suspension members 124 and 126 are each articulated relative to the housing 110 around an axis X124, X126, respectively, parallel to the axis X114.

The suspension member 124 comprises a base element 1241 that is secured to a threaded rod 1242 and is immobilized on the housing 110 using a screw 1243 that defines the axis X124. A hub 1244 is screwed on the threaded rod 1242. This hub supports two rollers 1245 and 1246 rotatably mounted on the hub 1244 around an axis A124 whose orientation relative to the housing 110 is variable.

In fact, as shown in FIG. 7, the rollers 1245 and 1246 are mounted on a shared shaft 1247, formed by a screw 1247A and a threaded sleeve 1247B, which is received in a housing 1248 with a circular section that comprises a central part, the diameter of which is adjusted relative to the diameter of the shaft 1247 and which widens toward the rollers 1245 and 1246. In other words, the housing 1248 is bobbin-shaped. Thus, the shaft 1247 can pivot around an axis Z124 that is perpendicular to the axis X124 and constitutes a longitudinal axis for the parts 1241, 1242 and 1244. This construction allows the rollers 1245 and 1246 to follow a turn or a curved zone of the rail 50 during movements of the carriage 100 along the rail 50 in the direction of arrows F1 and F2.

The member 126 is identical to the member 124 and comprises a base element 1261 immobilized by a screw 1263 on the housing 110 as well as a hub 1264 screwed on a threaded rod 1262 and on which two rollers 1265 and 1266 are mounted that are connected by a shaft 1267 received in a housing 1268 of the hub 1264.

The rollers 1245 and 1265 are provided to roll on a track 51 formed inside the rail 50, while the rollers 1246 and 1266 are provided to roll on another track 52 also formed inside the rail. The tracks 51 and 52 are arranged on either side of the passage slot 53 for the hubs 1244 and 1264.

The tracks 51 and 52 constitute the upper surfaces of two wings 54 and 55 of the rail 50 between which the slot 53 is defined. The lower surfaces 56 and 57 of the wings 54 and 55, i.e., their surfaces opposite the tracks 51 and 52, together constitute a rolling surface for the friction wheel 112.

The carriage 100 also comprises a cradle 150 made from several folded and cut strips of sheet metal. The cradle 150 comprises a main body 151, a longitudinal axis of which is denoted A151. The body 151 has a U-shaped cross-section with an upside down flat bottom. A staple 152, also with a U-shaped upside down flat bottom, is fastened on the body 151 near its front end 1512. The staple 152 bears a tab 153 in which two openings 1532 and 1534 are formed for receiving hooks (not shown) fastened in the upper part of the curtain 10. Near its rear end 1514, the main body 151 bears a second staple 154 provided with an opening 1542 for receiving a hook (not shown) fastened on the curtain. Thus, the upper left part of the curtain can be secured to the cradle 150 by engaging hooks in the openings 1532, 1534 and 1542. The curtain part coupled on the cradle, i.e., its first panel P11, conceals the cradle 150 and the housing 110.

The cradle 150 is equipped with two skids 155 and 156 with a T-shaped cross-section that are designed to be engaged in the inner volume V50 at the rail 50, like the rollers mentioned above. The wings 1552, 1554, 1562 and 1564 of the skids 155 and 156 are provided to slide on the tracks 51 and 52.

The skids 155 and 156 are pivotably mounted, relative to the body 151, around axes Z155 and Z156 that are perpendicular to the axis Z151 and the upper web 1513 of that body corresponding to the flat bottom of the rail. The variable orientation of the skids 155 and 156 relative to the axis A151 allows them to follow a turn of the rail 50.

The upper web 1513 of the body 151 is pierced with three openings, i.e., a central opening 1515 for passage of the wheel 112, a front opening 1516 for passage of the hub 1244, and a rear opening 1517 for passage of the hub 1264.

Furthermore, the housing 110 is provided, on either side of the wheel 112, with two flanges 128 and 130 that define, between them and the wheel 112, two zones Z1 and Z2 for partial reception of the sides 1518 and 1519 of the body 151.

Thus, it is possible to mount the cradle 150 of the housing 110 in the configuration of FIGS. 3 and 4, where the wheel 112 passes through the opening 1515, while the hubs 1244 and 1264 pass through the openings 1516 and 1517 and the sides 1518 and 1519 of the body 151 are received in the zones Z1 and Z2.

In this configuration, the rollers 1245, 1246, 1265 and 1266 and the skids 155 and 156 can be received at the same time in the inner volume V50 of the rail 50, while bearing on the tracks 51 and 52.

Thus, the housing 110 and the cradle 150 are suspended from the rail 50 by the members 124, 126 on the one hand, and 155 and 156 on the other hand, independently of each other.

In this configuration, the friction wheel 112 bears against the rolling surface formed from the surfaces 56 and 57 and, when it is driven by the motor 116 and the reducing gear 118, it can move the housing 110 along the rail 50, forward in the direction of arrow F1 or backward in the direction of arrow F2. By moving forward, in the direction of arrow F1, the housing 110 bears, by the hub 1244, against the front edge 1516A of the opening 1516. On the contrary, when the housing moves in the direction of arrow F2, the hub 1264 bears against the rear edge 1517B of the opening 1517. The suspension members 124 and 126, and more particularly their hubs 1244 and 1264, therefore serve to transmit a force F3 moving the housing 110 to the cradle 150, along the rail 50.

The openings 1516 and 1517 each have a length L151, parallel to the axis A151, and a width l151, perpendicular to the axis, that are greater than the dimensions of the hubs 1244 and 1265 measured parallel to a longitudinal axis A110 of the housing 110 and perpendicular to the axis. There is therefore a possibility of relative movement between the housing 110 and the cradle 150 when the cradle 150 is mounted on the housing 110, as shown by arrows F4 and F5 in FIG. 4. This possibility of relative movement makes it possible to adjust the relative position of the housing 110 and the cradle 150, in particular when passing over turns of the rail 50. This also avoids transmitting, to the housing 110 and therefore the wheel 112, parasitic forces due to the successive movement of the panels P11 to P16, as well as the tilting torque due to the weight of the curtain exerted in an offset manner relative to the axes A110 and A151. When the dimensions of these openings 1516 and 1517 allow the passage of the rollers 1245 and 1265, the cradle 150 can be mounted on the housing after the suspension members 124, 126 are installed on the housing 110. In the opposite case, the suspension members 124, 126 can be placed after mounting the cradle 150 on the housing 110.

The axes Z124, Z126, Z155 and Z156 are normally perpendicular to the tracks 51 and 52, with the exception that the members 124 and 126 can pivot, with an amplitude limited by the length L151, around the axes X124 and X126. In practice, this pivoting possibility is less than 20°, such that the axes Z124 and Z126 can be considered globally perpendicular to the tracks 51 and 52. Furthermore, the axes Z124, Z126, Z155 and Z156 are perpendicular to the axis X112.

Along the axis A110, the members 124 and 126 are positioned on either side of the members 155 and 156, which in turn are positioned on either side of the wheel 112. This imparts good stability to the carriage 100, including during its movement.

The weight of the housing 110 and its component elements is constant during the operation of the carriage 100, and the suspension members 124 and 126 support only that weight. This weight is known and stable. The dimensions of the wheel 112 and the members 124 and 126 are chosen so that the contact force between the friction wheel and the rolling surface formed by the surfaces 56 and 57 is sufficient to avoid, or at least greatly limit, the sliding between the wheel 112 and the rolling surface.

Furthermore, the weight of the curtain 10 in motion, i.e., the driven part of the curtain, which varies depending on the position of the carriage 100 along the rail 50, is supported by the different carriages 20 supporting the curtain. The variation in this weight therefore does not affect the quality of the contact force between the wheel 112 and the rolling surface.

The weight of the first curtain panel P11 is supported exclusively by the cradle 150 and the skids 155 and 156. During a movement of the housing 110 relative to the cradle, the cradle moves the axis Z126 of the suspension member 126 by pressing, using the edge of the opening 1517 opposite the edge 1517A, against the hub 1264. This causes the member 126 to tilt in the clockwise direction in FIG. 3, and thereby affects the contact force between the wheel 112 and the rolling tracks formed by the surfaces 56 and 57, using the approach considered in WO-A-2012/004530. In fact, the tilting of the member 126 around the axis X126 results in bringing the axis A126 closer to the axis X112 in a direction perpendicular to the surfaces 56 and 57, and thereby increasing the contact force. The greater the weight of the first curtain panel P11 and/or the driven curtain part is, the more the axis Z126 of the suspension member 126 is moved relative to the perpendicular axis, and the greater the contact force is. On the contrary, for lightweight curtains, the contact force is lower, which allows lower electricity consumption and greater autonomy. Thus, as in WO-A-2012/004530, the contact force varies based on a resistive force that depends on the evolution of the load pulled or pushed by the carriage 100 during its movement.

The hubs 1244 and 1246 have a circular section and they respectively bear against the front edge 1516A of the opening 1516 and against the rear edge 1517B of the opening 1517, which are rectilinear, in the movement direction of the carriage 100, to transmit a driving or pulling force F3 that is oriented forward in the example of FIGS. 6 and 7. This force F3 is tangent to a median axis Y50 of the rail 50. The transmission of the traction force forward or backward takes place at the interface between a circular surface of a hub and a rectilinear edge of an opening, which makes it possible to limit the friction perpendicular to the axes A110 and A151, which are normally combined and which can be slightly off-centered in the turning zones of the rail 50.

In the second embodiment of the invention shown in FIGS. 8 and 9, the elements similar to those of the first embodiment bear the same references. Unless otherwise stated, these elements work in the same way as in the first embodiment.

The carriage 100 of this embodiment comprises a housing 110 in which a friction wheel 112 is received that is designed to roll on a rolling surface 56 provided in the lower part of a rail 50. The wheel 112 is driven by a motor 116 and a reducing gear 118. Two suspension members 124 and 126 equip the housing 110 and are provided with rollers 1245 and 1265 designed to roll on a track 51 inside the rail 50.

A cradle 150 is provided to couple a curtain (not shown) using tabs 153 and 154 pierced with passage openings for hooks mounted on the curtain. This cradle is equipped with two suspension members 155 and 156 also provided with rollers 1555 and 1556 provided to roll on the tracks 51 of the rail 50.

The carriage 110 is equipped with two push-pieces 132 and 134, the outer surface of which, opposite the wheel 112, is rounded and convex. In practice, the outer surface of the push-pieces 132 and 134 is a cylinder segment with a vertical axis in the configuration of the carriage 100 mounted on the rail 50.

The cradle 150 is equipped with two other push-pieces 162 and 164 complementary to the push-pieces 132 and 134 and which each have a surface oriented toward the housing 110 that is rounded and convex, like the outer surface of the push-pieces 132 and 134. Thus, the traction force F3 between the carriage 110 and the cradle 150 when the carriage 110 moves in the direction of arrow F1 in FIGS. 8 and 9 is parallel to a tangent to the longitudinal axis Y50 of the rail 50. This makes it possible, to a large extent, to cancel out a component of that force normal to the curve of the rail 50, which is advantageous, since that normal component could generate friction capable of disrupting the output and transmission of force between the parts 110 and 150 of the carriage 100. Choosing appropriate materials also makes it possible to limit that friction.

As shown in FIG. 9, when the front push-pieces 132 and 162 are in contact, they can slide against one another in the direction of the double arrow F4 perpendicular to the axis Y50 and the force F3. Furthermore, in that position, the rear push-pieces 134 and 164 are not in contact and can therefore move relative to one another both perpendicular to the axis Y50, in the direction of the double arrow F4, and parallel to that axis, in the direction of the double arrow F5.

The invention has been shown in the first embodiment in the case where the suspension members 155 and 156 of the cradle 150 are formed by skids. Alternatively, and as shown in the second embodiment, these suspension members may comprise rollers rolling on the tracks of the rail. Alternatively, the suspension members of the housing of the first embodiment or the housing and the cradle of the second embodiment can comprise sliding skids.

According to still another alternative, openings comparable to those 1516 and 1517 of the first embodiment can be provided on the housing 110, for the passage of suspension members of the cradle 150.

The technical characteristics of the embodiments and alternatives considered above may be combined.

The invention claimed is:

1. A motor-driven carriage for opening/closing a curtain, the carriage comprising:

a housing that is provided with two suspension members configured to suspend the housing from a rail having at least one rolling surface with which a friction wheel, which is driven by an electric motor, is configured to come into contact;

a cradle provided with two suspension members configured to suspend the cradle from the rail that are independent of the suspension members of the housing, and with curtain coupling means for coupling to the curtain, the cradle being mounted onto the housing and being driven by the housing when the housing moves along the rail, the housing and the cradle being configured for relative movement, wherein the cradle is provided with a passageway for the friction wheel.

2. The carriage according to claim 1, wherein the suspension members of the housing support only a weight of the housing and elements that the housing contains, the weight being constant, and the suspension members of the cradle withstand a driven load, the driven load being variable based on the position of the carriage along the rail.

3. The carriage according to claim 1, wherein a first element that is one of the housing and the cradle is provided with at least one opening for the passage, with play, of a part belonging to or integral with a second element that is the other of the housing and the cradle.

4. The carriage according to claim 3, wherein the first element comprises two openings, a suspension member for the second element being engaged with play in each of the two openings.

5. The carriage according to claim 4, wherein the first element is configured to move at least one suspension member relative to the second element, by varying a contact force between the friction wheel and the rolling surface.

6. The carriage according to claim 4, wherein each opening has, in a longitudinal direction parallel to a direction of movement of the carriage and in a transverse direction perpendicular to the direction of movement of the carriage, dimensions larger than dimensions, along the two longitudinal and transverse directions, of a part of the suspension member that is received in the respective opening.

7. The carriage according to claim 4, wherein the first element is the cradle, which is provided with a third passage opening for the friction wheel, and the second element is the housing.

8. The carriage according to claim 7, wherein the third passage element is situated, along a longitudinal axis of the cradle, between the two passage openings of the suspension members of the housing.

9. The carriage according to claim 1, wherein in the mounted configuration of the carriage, the suspension members of the housing are positioned, along the longitudinal axis of the housing, on either side of the suspension members of the cradle, the suspension member being positioned, along the longitudinal axis, on either side of the friction wheel.

10. The carriage according to claim 1, wherein the cradle is mounted on the carriage having configured for relative movement in a direction parallel to a longitudinal axis of the carriage and in a direction perpendicular to that axis.

11. The carriage according to claim 1, wherein each suspension member of the housing and/or each suspension member of the cradle is equipped with at least one roller or at least one skid interacting with a track of the rail, and wherein the at least one roller or the at least one skid is configured to be articulated, relative to the housing and/or the cradle, around an axis globally perpendicular to the track of the rail in the configuration of the carriage mounted on the rail and perpendicular to the axis of rotation of the friction wheel.

12. The carriage according to claim 11, wherein at least one of the suspension members comprises two rollers articulated on a support positioned between the rollers, using a shaft received in a circular housing of the support, and wherein the circular housing has a section that widens toward the rollers.

13. The carriage according to claim 1, wherein the housing defines at least one volume for partially receiving the cradle.

14. The carriage according to claim 5, wherein the first element is the cradle, which is provided with a third passage opening for the friction wheel, and the second element is the housing.

15. The carriage according to claim 6, wherein the first element is the cradle, which is provided with a third passage opening for the friction wheel, and the second element is the housing.

16. An installation for blacking out an opening, comprising:

a rail;

a motor-driven carriage according to claim 1; and a curtain coupled on the cradle of the carriage.

* * * * *